US009085390B2

(12) United States Patent
Li et al.

(10) Patent No.: US 9,085,390 B2
(45) Date of Patent: Jul. 21, 2015

(54) ADJUSTABLE STORAGE BOX

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Guang-Long Li, Shenzhen (CN); Hai Liu, Shenzhen (CN); Ming-Chang Lee, New Taipei (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/325,057

(22) Filed: Jul. 7, 2014

(65) Prior Publication Data

US 2015/0014309 A1 Jan. 15, 2015

(30) Foreign Application Priority Data

Jul. 12, 2013 (CN) ..... 2013 1 02925572

(51) Int. Cl.
*B65D 21/08* (2006.01)
*B65D 6/18* (2006.01)

(52) U.S. Cl.
CPC ..... *B65D 21/086* (2013.01); *B65D 11/1833* (2013.01)

(58) Field of Classification Search
CPC ..... B65D 7/32; B65D 7/30; B65D 7/28; B65D 7/24; B65D 11/1873; B65D 11/18; B65D 11/1866; B65D 21/086; B65D 21/068; B65D 88/526; B65D 88/10
USPC ..... 220/4.33, 4.28, 7, 6, 8, 629, 628; 206/600, 386
See application file for complete search history.

(56) References Cited

U.S. PATENT DOCUMENTS 1,433,169 A * 10/1922 Zimmerman ..... 220/6
4,863,056 A * 9/1989 Inayama ..... 220/6

FOREIGN PATENT DOCUMENTS

GB 614079 A * 12/1948 ..... B65D 21/086

* cited by examiner

*Primary Examiner* — Robert J Hicks
(74) *Attorney, Agent, or Firm* — Novak Druce Connolly Bove + Quigg LLP

(57) ABSTRACT

A storage box includes a base, two opposite first side plates coupled to the base and two opposite second side plates coupled to the base and connecting the two first side plates. The base includes two base plates coupled to each other. Each base plate includes a fixing flange, a first sliding flange and a second sliding flange extending from the fixing flange. The first side plates are pivotally coupled to the fixing flanges of the base plates. The second side plates each include two sliding plates respectively and pivotally coupled to the first sliding flange of a corresponding one of the base plates and the second sliding flange of the other one of the base plates. The two base plates are configured to be movable relative to each other. The two sliding plates of each second side plate are configured to be movable relative to each other.

17 Claims, 14 Drawing Sheets

ADJUSTABLE STORAGE BOX

FIELD

The present disclosure relates to storage boxes, and more particularly to an adjustable storage box.

BACKGROUND

Storage cases are convenient for storage and transportation.

DETAILED DESCRIPTION

Figure 1:
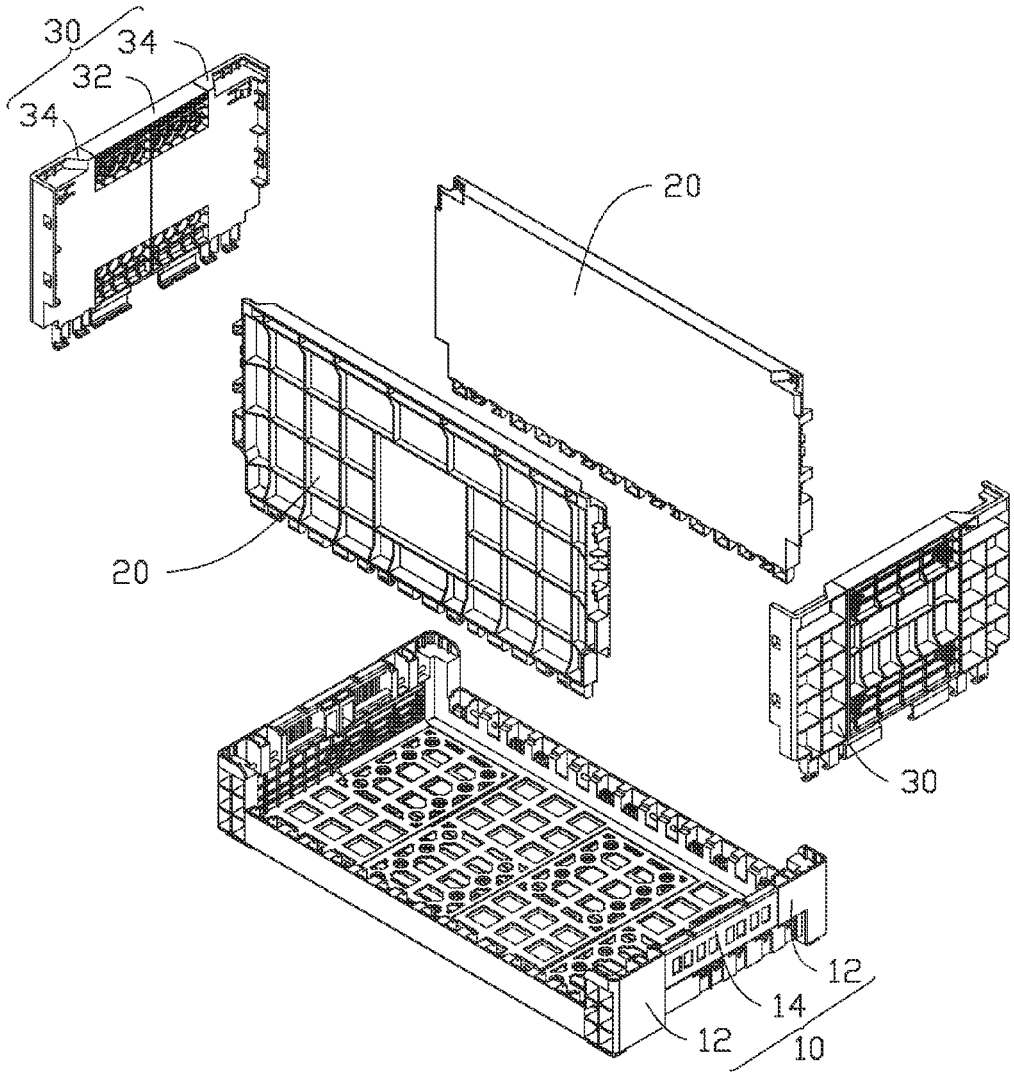
FIG. 1 is an exploded, isometric view of a storage box in accordance with an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

The present disclosure is described in relation to a storage box. The storage box can include a base, two opposite first side plates coupled to the base and two opposite second side plates coupled to the base and connecting the two first side plates. The base can include two base plates coupled to each other. Each base plate can include a fixing flange, a first sliding flange and a second sliding flange respectively extending from two opposite ends of the fixing flange. The two first side plates are pivotally coupled to the fixing flanges of the base plates of the base. The two second side plates each can include two sliding plates respectively and pivotally coupled to the first sliding flange of a corresponding one of the base plates and the second sliding flange of the other one of the base plates. The two base plates are configured to be movable relative to each other. The two sliding plates of each second side plate are configured to be movable relative to each other.

FIG. 1 illustrates a storage box in accordance with an embodiment of the present disclosure. The storage box can include a base 10, two opposite first side plates 20 coupled to the base 10, and two opposite second side plates 30 coupled to the base 10 and connecting the two first side plates 20.

Figure 2:
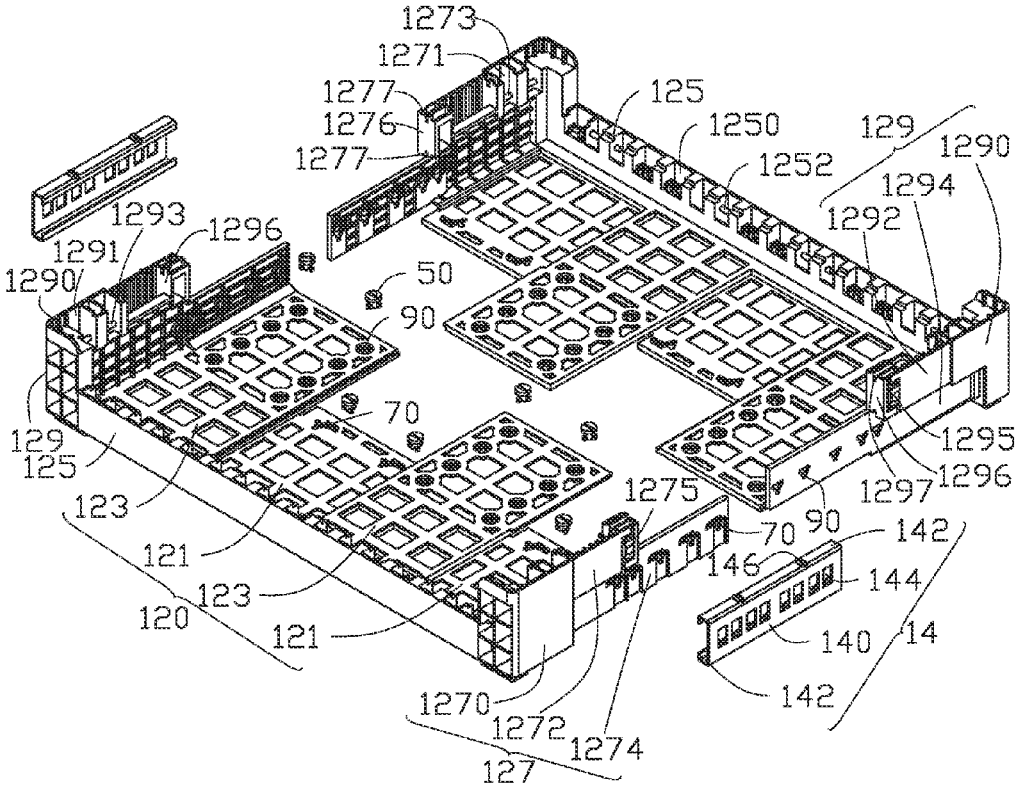
FIG. 2 is an exploded, isometric view of a base of the storage box in FIG. 1.

As illustrated in FIG. 1 and FIG. 2, the base 10 can include two base plates 12 coupled to the each other, and two coupling members 14 slidably connecting the two base plates 12. In this embodiment, the two base plates 12 can be spliced to each other and move relative to each other.

Each base plate 12 can include two spaced recess plates 121 and two spaced protrusion plates 123 staggered with the recess plates 121. The recess plates 121 of each base plate 12 are corresponding to the protrusion plates 123 of the other one of the base plates 12. The two spaced recess plates 121 and two spaced protrusion plate 123 of each base plates 12 cooperatively define a bottom face 120. Two bottom faces 120 of the two base plates 12 are joined together to define a base face 101. The base plates 12 each have a side vertically extending upwardly to form a fixing flange 125. The base plates 12 each have two ends thereof extending upwardly to form a first sliding flange 127 and a second sliding flange 129, respectively. Each recess plate 121 defines two spaced mounting holes 70 in a side thereof away from the fixing flange 125. Each protrusion plate 123 defines four spaced perforations 90 at a side thereof away from the fixing flange 125. Each fixing flange 125 has an inner side thereof defining a plurality of installing grooves 1250. Some of the installing grooves 1250 are engaged with a pivot 1252. The pivot 1252 can be a cylindrical shaft.

The first sliding flange 127 can include a first fixing seat 1270 extending from an end of the fixing flange 125, a first installing arm 1272 and a first sliding arm 1274 both extending from a side of the first fixing seat 1270 away from the fixing flange 125. The first fixing seat 1270 has an inner side defining two spaced installing grooves 1271 each having a pivot 1273 engaged therein. The first installing arm 1272 is stacked on the first sliding arm 1274. Each base plate 12 has the first installing arm 1272 remote from the recess plate 121, and the first sliding arm 1274 adjacent to the corresponding recess plate 121. The first installing arm 1272 and the first sliding arm 1274 both can substantially perpendicular to the fixing flange 125. The first installing arm 1272 can have an outer side thereof forming an indicating button 1275, the indicating button 1275 can be located at an end of the first installing arm 1272 remote from the fixing seat 1270. The first installing arm 1272 can have an inner side thereof forming a catch 1276 opposite to the indicating button 1275. The catch 1276 can define two spaced slots 1277 in top and bottom ends thereof. The first sliding arm 1274 can define a plurality of spaced mounting holes 70 in alignment with each other. In this embodiment, there are five mounting holes 70 spaced from each other at regular intervals.

The second sliding flange 129 can include a second fixing seat 1290 coupled to an end of the fixing flange 125, and a second installing arm 1292 and a second sliding arm 1294 both extending from a side of the second fixing seat 1290 away from the fixing flange 125. The second fixing seat 1290 has an inner side defining two spaced installing grooves 1291, each having a pivot 1293 engaged therein. The second installing arm 1292 is stacked on the second sliding arm 1294. Each base plate 12 has the second installing arm 1292 remote from the protrusion plate 123, and the second sliding arm 1294 adjacent to the corresponding protrusion plate 123. Both the second installing arm 1292 and the second sliding arm 1294 can be substantially perpendicular to the fixing flange 125. The second installing arm 1292 can have an outer side thereof forming an indicating button 1295. The indicating button 1295 can be located at an end of the second installing arm 1292 remote from the fixing seat 1290. The second installing arm 1292 can have an inner side thereof forming a catch 1296 opposite to the indicating button 1295. The catch 1296 can define two spaced slots 1299 in top and bottom ends thereof. The second sliding arm 1294 can define a plurality of spaced perforations 90 in alignment with each other. In this embodiment, there are five perforations 90 spaced from each other at regular intervals.

Each coupling member 14 is configured to couple the first sliding flange 127 of one of the base plates 12 and the second sliding flange 129 of the other of the base plates 12. Each coupling member 14 can include a face plate 140 and two fastening plates 142 extending from top and bottom sides of the face plate 140. The face plate 140 can define two units of windows 144, each unit of windows 144 can include four windows 144 spaced from each other with an interval. The windows 144 of the two units can be in alignment with each other. The fastening plate 142 extending from the top side of the face plate 140 can extend two spaced lugs 146 outwardly. In this embodiment, the coupling member 14 is substantially C-shaped. Each fastening plate 142 can comprise a main portion substantially perpendicular to the face plate 140 and a coupling edge extending from the main body and substantially parallel to the face plate 140.

Figure 3:
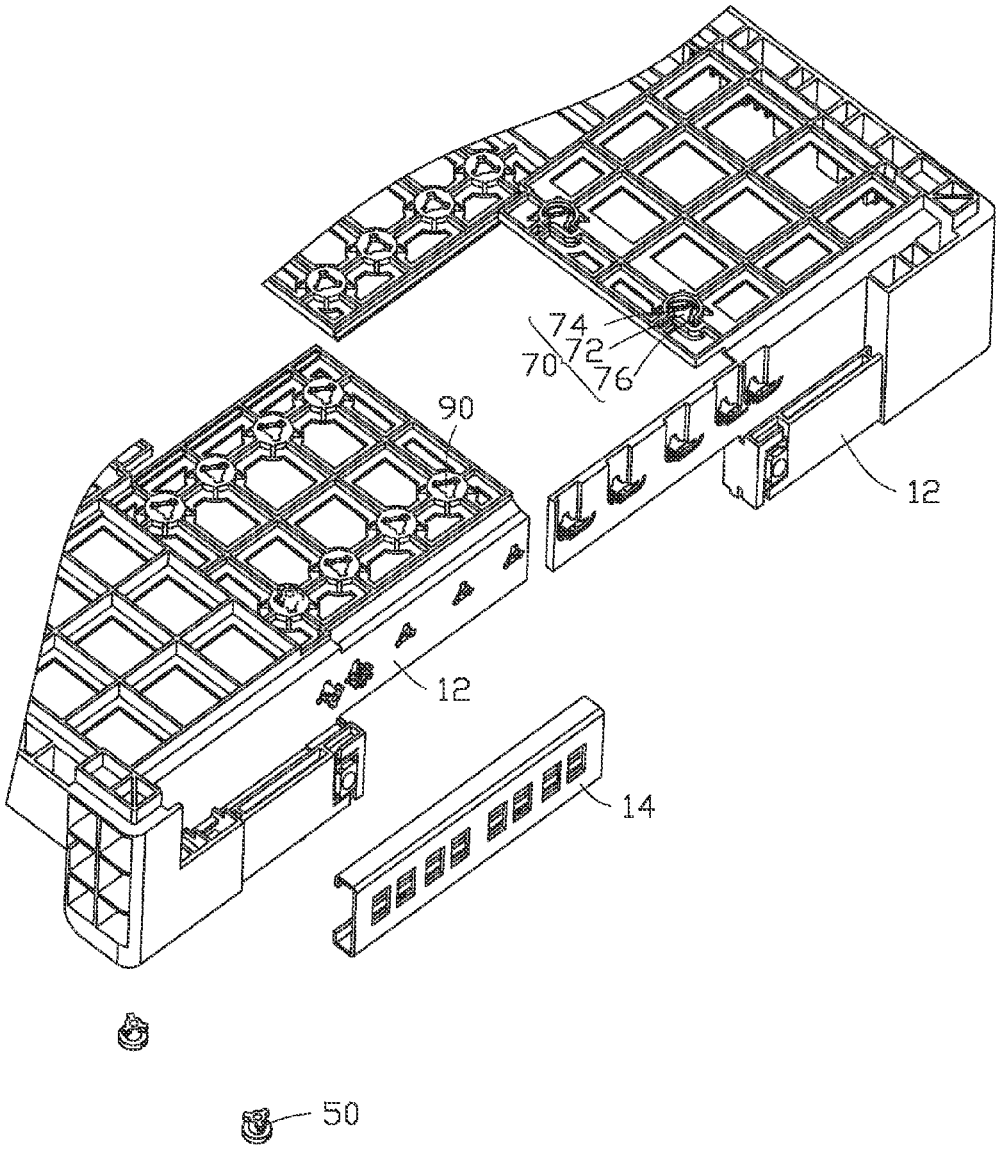
FIG. 3 is an enlarged view of a part of the base in FIG. 2, viewed from a different angle.
Figure 4:
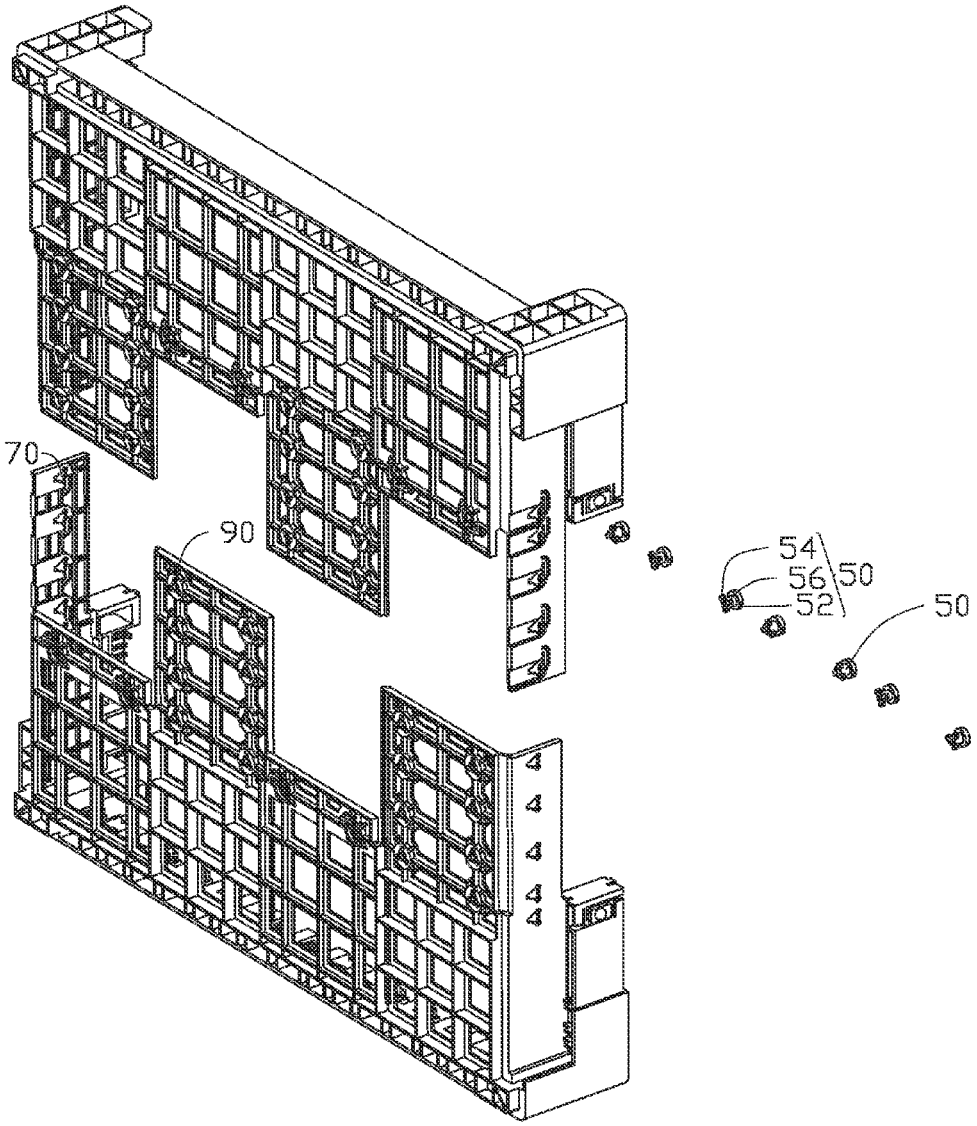
FIG. 4 is an exploded, isometric view of the base in FIG. 2, viewed from a different angle.
Figure 5:
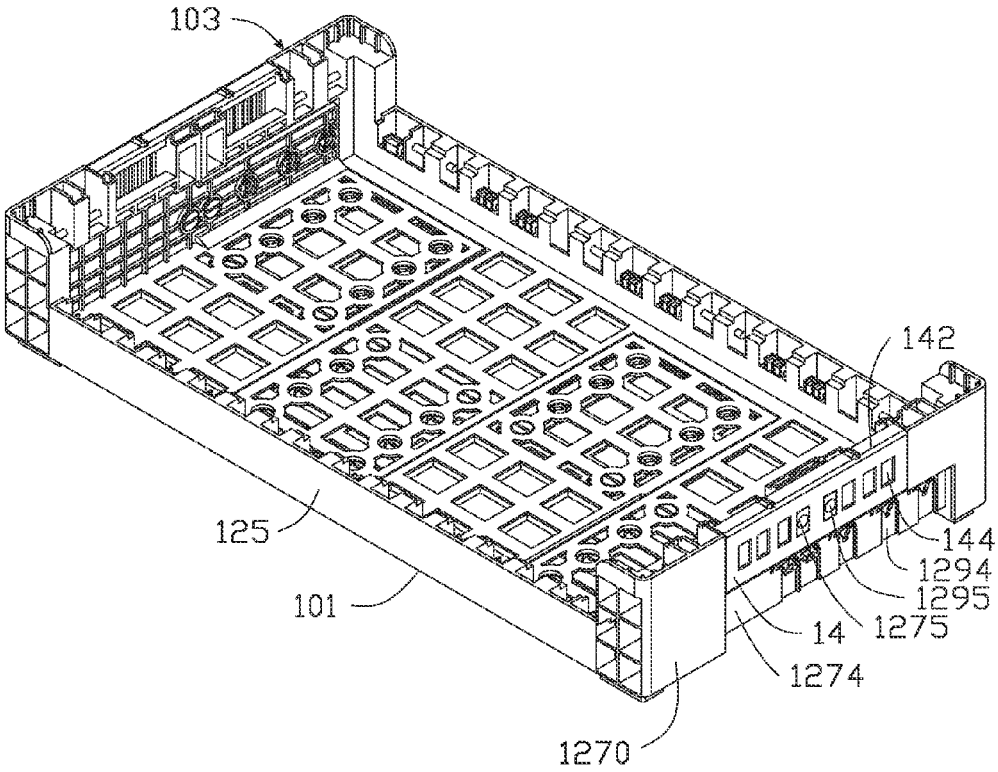
FIG. 5 is an assembled, isometric view of the base in FIG. 2.

Referring to FIGS. 3-5, when assembling the base 10, the two base plats 12 are arranged to face each other, the first installing arms 1272 and the second installing arms 1292 face each other respectively and are received in corresponding coupling members 14, and the coupling edges of the coupling member 14 are retained in the slots 1279, 1299 of the catches 1276, 1296. The first sliding arm 1274 slides on a face of the second sliding arm 1294, and the protrusion plates 123 slide on faces of the recess plates 121, until the indicating buttons 1275, 1295 of the first installing arms 1272 and the second installing arms 1292 are received in the windows 144 of the face plates 140 of the two coupling members 14. Here, the mounting holes 70 of the first sliding arm 1274 can correspond to the perforations 90 of the second sliding arm 1294. Fasteners 50 can extend through the perforations 90 and be located in corresponding mounting holes 70. Therefore, the first sliding arm 1274 of each plate 12 is retained to the second sliding arms 1294 of the other base plate 12. The first sliding flange 127 and the corresponding second sliding flange 129 can cooperatively form a sliding flange 103 of the base 10. The protrusion plates 123 of each base plate 12 are located on the recess plates 121 of the other base plate 12, the mounting holes 70 of the recess plates 121 are corresponding to the perforations 90 of the protrusion plates 123, fasteners 50 can extend through the perforations 90 of the protrusion plates 123 and be located in the corresponding mounting holes 70 of the recess plates 121, therefore, the two base plates 12 are retained together.

In this embodiment, the fastener 50 can include a head 52, a claw 54 and a neck 56 located between and connecting the head 52 and the claw 54. The perforation 90 has a profile equal to that of the fastener 50. The mounting hole 70 can include a pre-hole 72 having a profile equal to that of the perforation 90, a blocking portion 74 under the pre-hole 72 and an abutting portion 76 located aside the blocking portion 74. When mounting the fastener 50 to the mounting hole 70, the claw 54 extends through the pre-holes 72 and located at a side of the blocking portion 74, the fastener 50 is rotated sixty degrees to have the claw 54 blocked by the blocking portion 74 and the abutting portion 76. When detaching the fastener 50 from the mounting hole 70, the fastener 50 is rotated sixty degrees inversely, the claw 54 is disengaged with the blocking portion 74 and the abutting portion 76, the fastener 50 can be taken out of the pre-hole 72.

Figure 6:
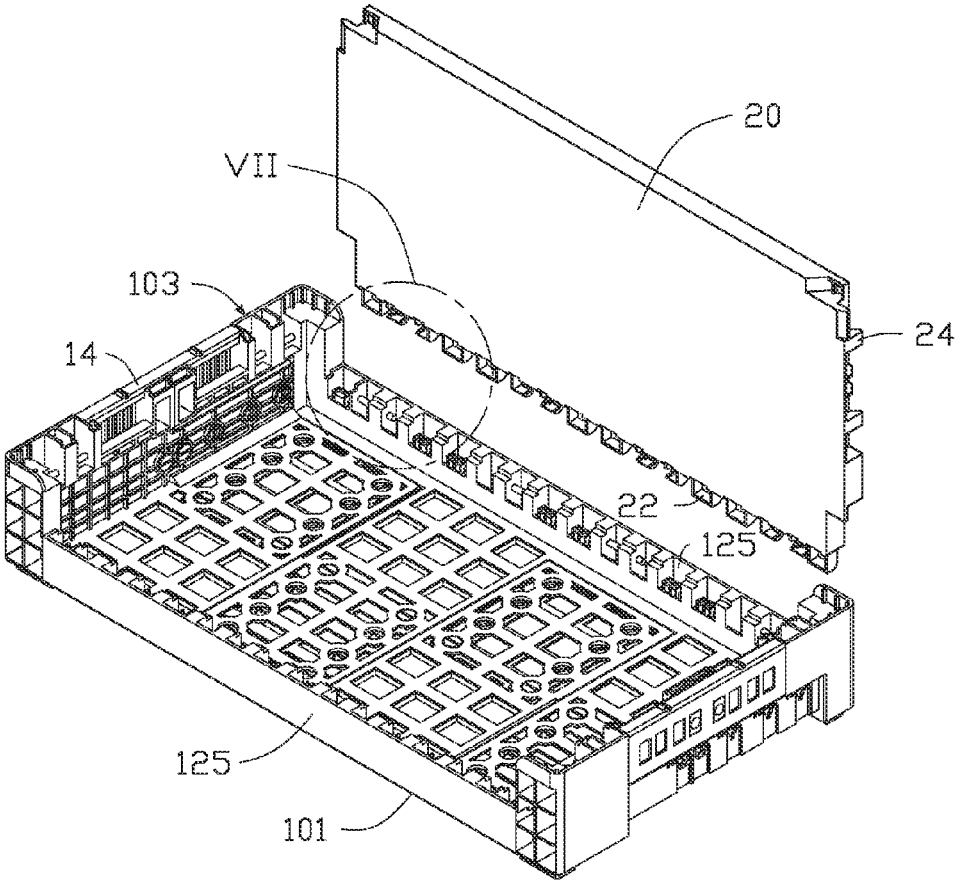
FIG. 6 is an enlarged, isometric view of a base and a first side plate of the storage box in FIG. 1.
Figure 7:
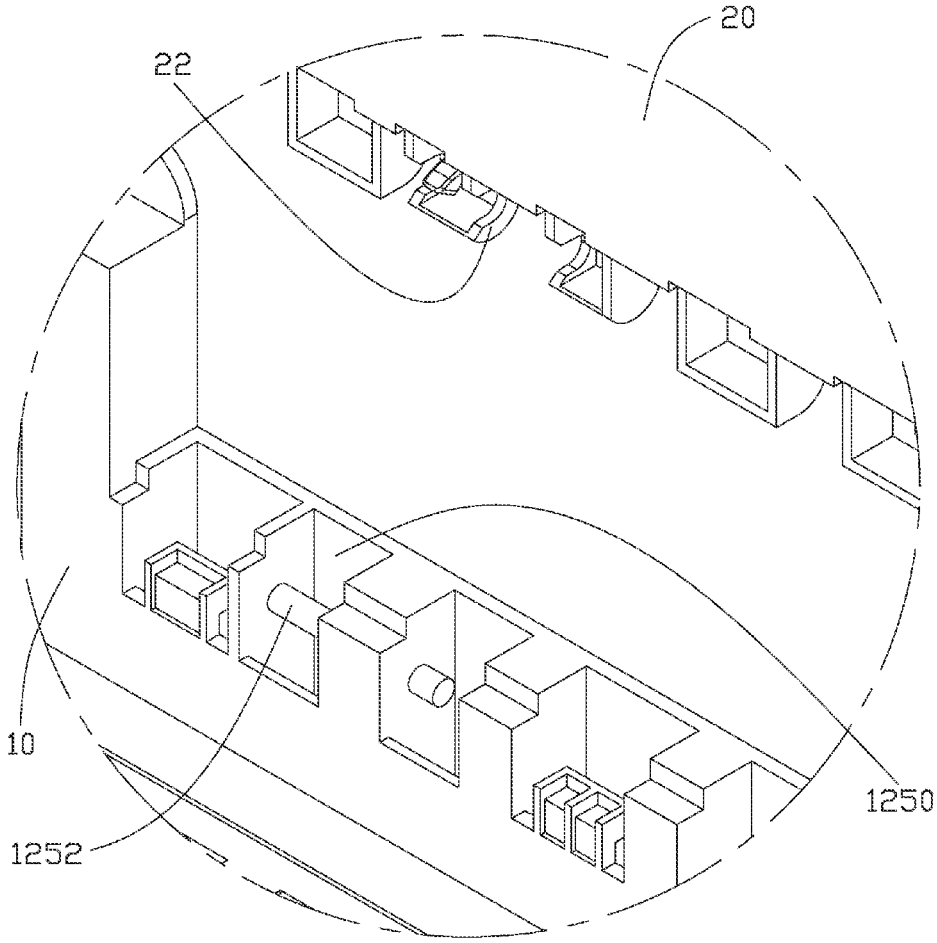
FIG. 7 is an enlarged view of circled portion VII in FIG. 6.

Referring to FIGS. 6-7, the first side plate 20 can has a length equal to that of the fixing flange 125. The first side plate 20 can form a plurality of grabs 22 configured to be coupled to the installing grooves 1250 of the fixing flange 125. The grabs 22 can extend from a bottom side of the first side plate 20 toward the fixing flange 125. Some of the grabs 22 are configured to engage with the pivots 1252 in the installing grooves 1250. The first side plate 20 can extend two buckles 24 outwardly from each of two opposite lateral sides of the first side plate 20.

Figure 8:
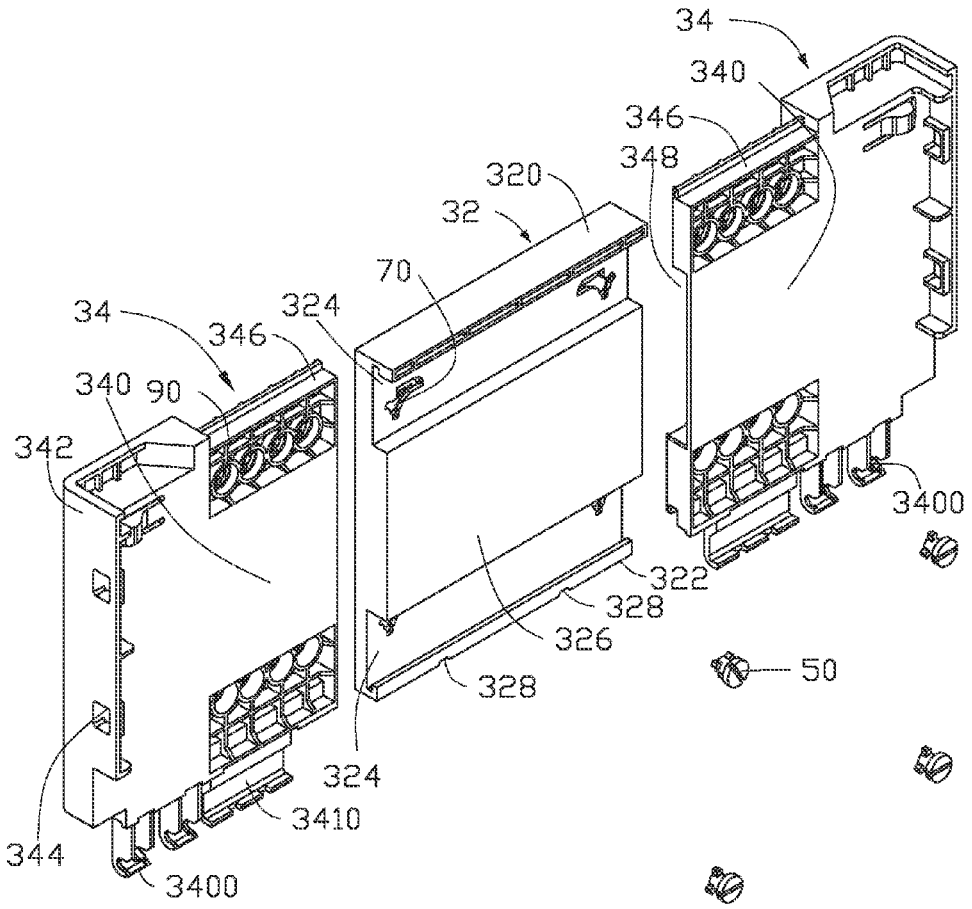
FIG. 8 is an exploded, isometric view of a second side plate of the storage box in FIG. 1.

Referring to FIG. 1 and FIG. 8, the second side plate 30 can include a middle plate 32, and two sliding plates 34 located at two opposite sides of the middle plate 32 respectively. The middle plate 32 can include a top face 320 and bottom face 322. The middle plate 32 can define two engaging grooves 324 adjacent to the top face 320 and the bottom face 322 respectively. Each engaging groove 324 can define two mounting holes 70 in two end portions of the engaging groove 324. The middle plate 32 can form a protrusion portion 326 between the two engaging grooves 324. The bottom face 322 defined two spaced recesses 328 configured to match the lugs 146 of the coupling member 14. Each sliding plate 34 can include a sliding face plate 340 and an installing face plate 342 substantially perpendicularly extending from a side of the sliding face plate 340. The installing face plate 342 can define two fixing holes 344 configured to receive the buckles 24 of the first side plate 20. The sliding face plate 340 defines a receiving groove 348 in a middle portion of an outer side remote from the installing face plate 342. The sliding face plate 340 can form two sliding portions 346 at two opposite sides of the receiving grooves 348. Each sliding portion 346 can define a plurality of perforations 90 corresponding to the mounting holes 70 in the corresponding engaging groove 324. In this embodiment, there are four perforations 90 in the sliding portion 346 spaced to each other at regular intervals. The two sliding portions 346 each extend two spaced grabs 3400 configured to be coupled to the installing grooves 1291 of the second fixing seat 1290. The two sliding portions 346 each can further extend an installing board 3410 adjacent to the middle plate 32.

Figure 9:
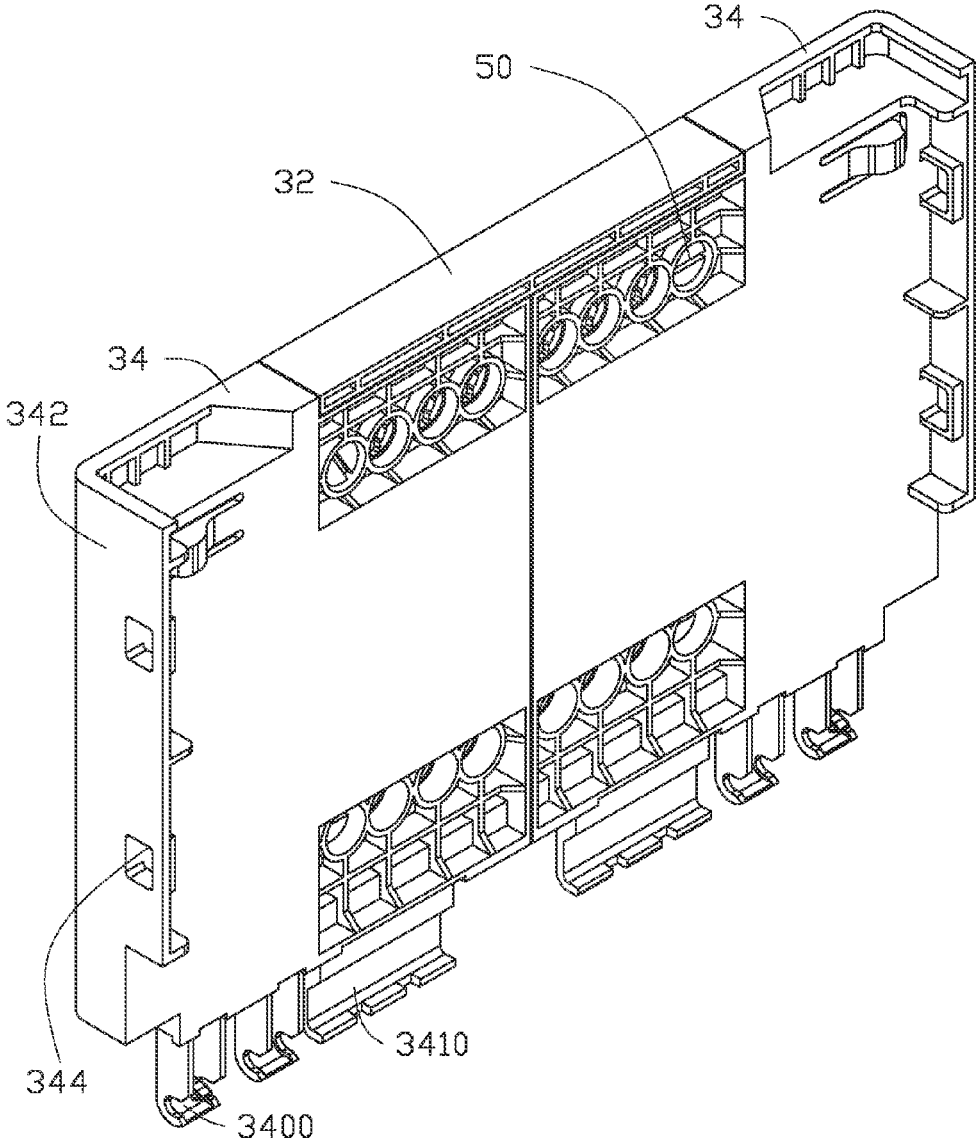
FIG. 9 is an assembled, isometric view of the second side plate in FIG. 8.

Referring to FIG. 9, when assembling the second side plate 30, the two sliding plates 34 each have the two sliding portions 346 inserted into the engaging grooves 324 of the middle plate 32. The protrusion portion 326 of the middle plate 32 is received in the receiving grooves 348 of the two sliding plates 34. The mounting holes 70 in the engaging grooves 324 correspond to the perforations 90 of the two sliding portions 346. Fasteners 50 can extend through the perforations 90 and are located into the mounting holes 70. Therefore, the two sliding plates 34 are retained to the middle plate 32.

Figure 10:
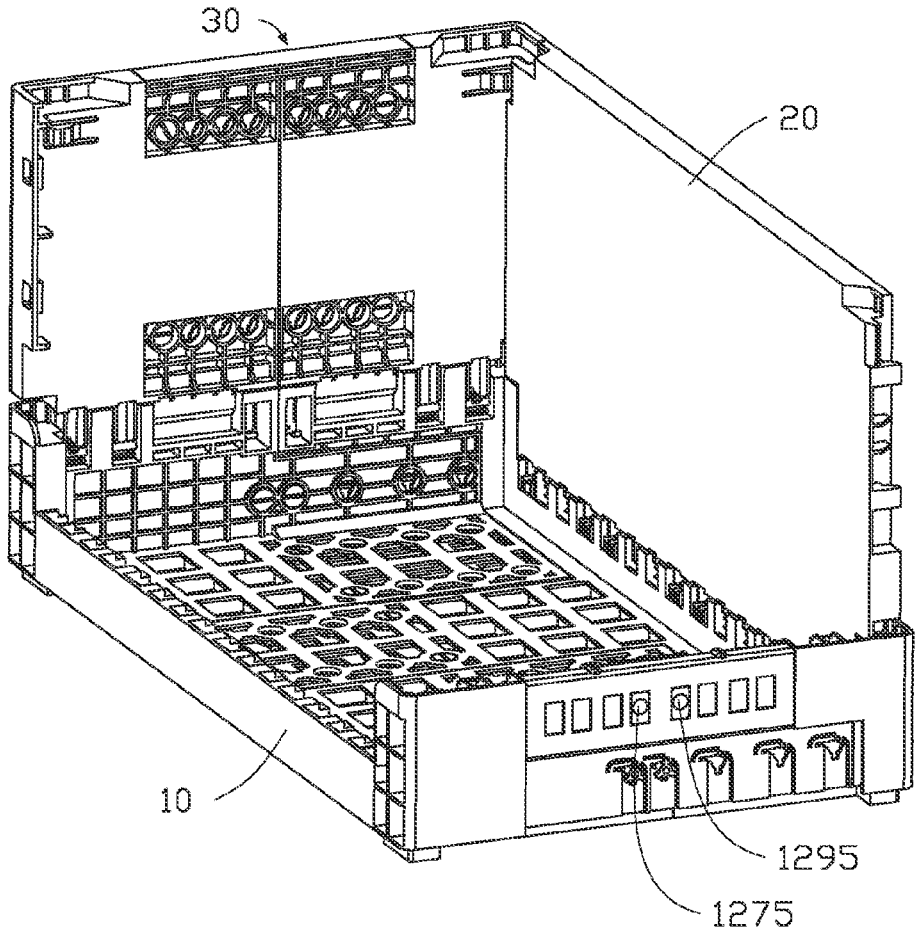
FIG. 10 is an assembled, isometric view of a base, a first side plate and a second side plate of the storage box in FIG. 1.
Figure 11:
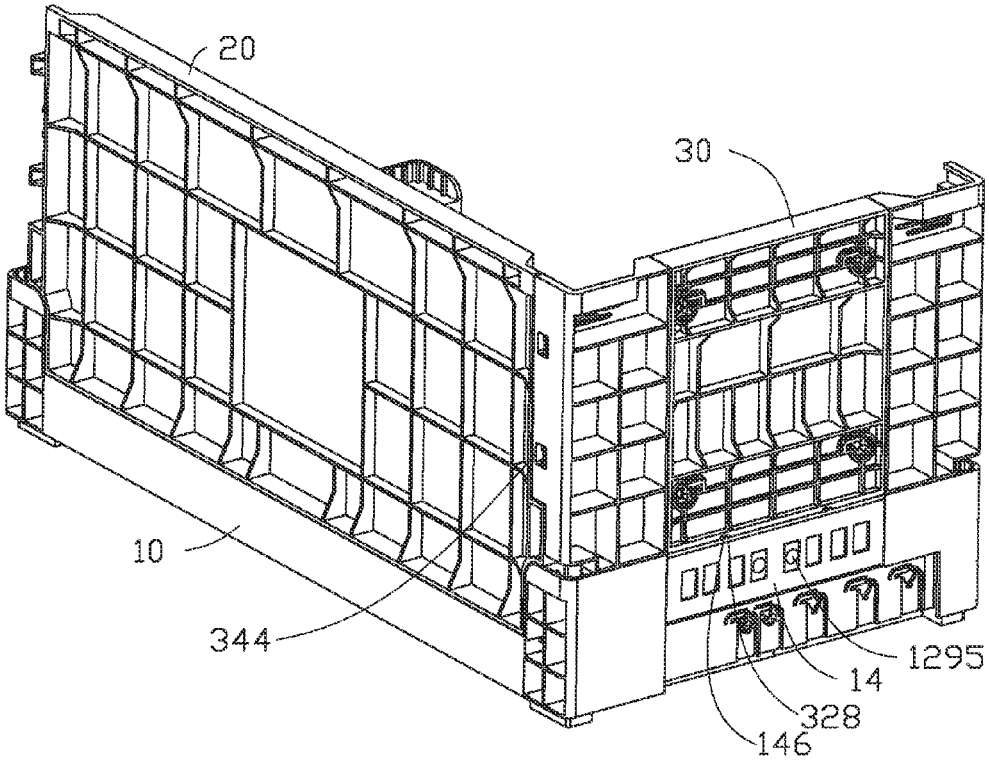
FIG. 11 is another view of FIG. 10, viewed from a different angle.
Figure 12:
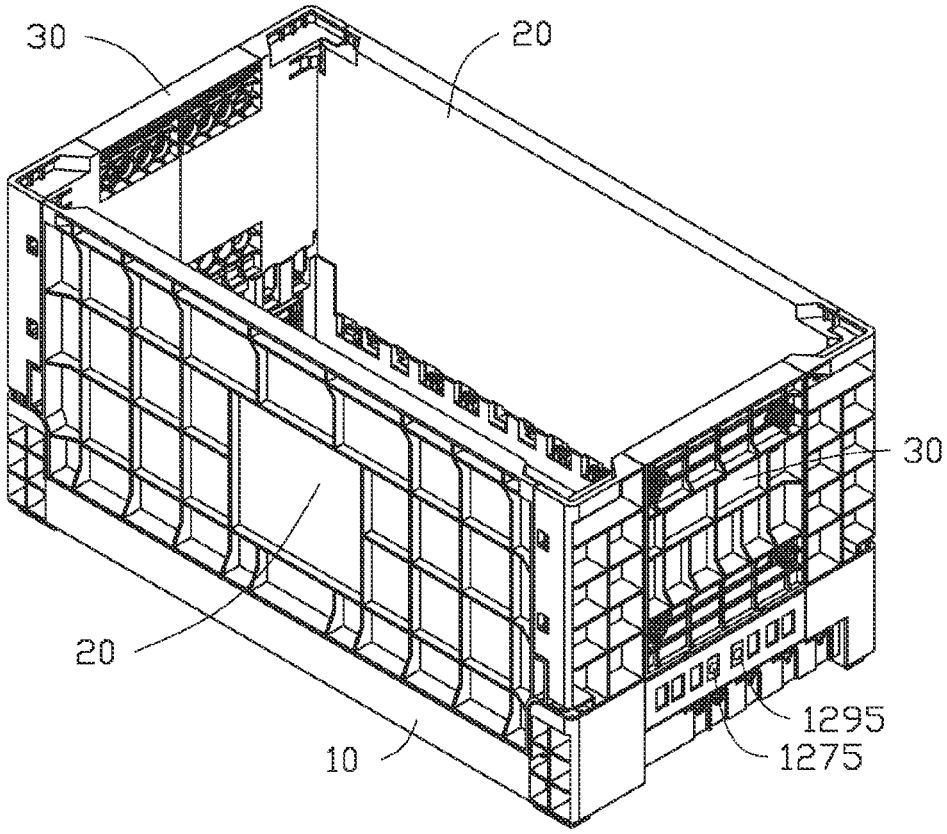
FIG. 12 is an assembled, isometric view of the storage box in FIG. 1, wherein the storage box has a first width.

Referring to FIGS. 10-12, when assembling the storage box, the first side plate 20 has the grabs 22 received in the installing grooves 1250 of a corresponding fixing flange 125, some of the grabs 22 rotatably engage the pivots 1252 in the installing grooves 1250, thereby pivotally coupling the first side plate 20 to the fixing flange 125. One of the second side plates 30 has the grabs 3400 received in the installing grooves 1291 of a corresponding second fixing seat 1290 and rotatably engage the pivots 1293 in the installing grooves 1291. The other of the second side plates 30 has the grabs 3400 received in the installing grooves 1271 of a corresponding first fixing seat 1270 and rotatably engage the pivots 1273 in the installing grooves 1271. The second side plate 30 has the installing board 3410 installed to an inner side of the coupling member 14, thereby pivotally coupling the second side plate 30 to the first sliding flange 127 and the second sliding flange 129 of the base 10. The coupling member 14 has the lugs 146 engaged in the recesses 328 of the middle plate 32 of the second side plate 30. The first side plate 20 has the buckles 24 engaged into the fixing holes 344 of the installing face plate 342 of the second side plate 30, thereby coupling the first side plate 20 to the second side plate 30.

Figure 13:
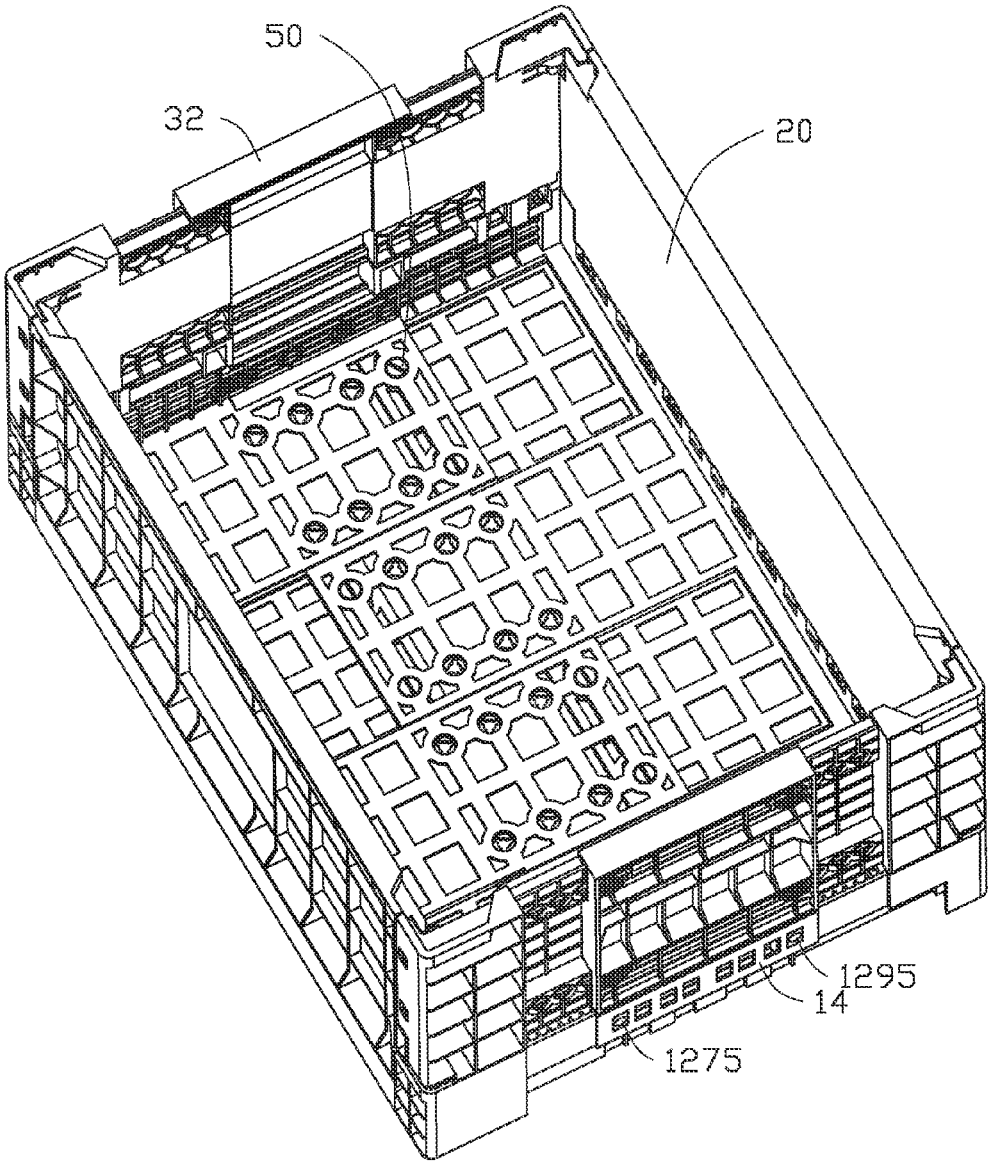
FIG. 13 is an assembled, isometric view of the storage box in FIG. 1, wherein the storage box has a second width.

Referring to FIG. 13, when the storage box is to be adjusted to have a first width, the first width can be a maximum width between the two first side plates 20, the fasteners 50 are removed, the two base plates 12 are drawn outwardly from the coupling members 14, and the two second side plates 30 each have the two sliding plates 34 moving outwardly from the middle plate 32, the coupling member 14 is unmovable relative to the middle plate 32 via the lugs 146 of the coupling member 14 engaging in the recesses 328 of the middle plate 32. When the indicating buttons 1275, 1295 of the first installing arm 1272 and the second installing arm 1292 are respectively received in two outermost windows 144 of the coupling member 14, the mounting holes 70 of the recess plates 121 correspond to two outmost perforations 90 of the protrusion plates 123 of the base plates 12, the fasteners 50 are extended through the perforations 90 and are locked in the mounting holes 70. Therefore, the storage box having the maximum width is obtained.

Referring to FIG. 12, when the storage box is to be adjusted to have a second width, the second width can be a minimum width between the two first side plates 20, the fasteners 50 are removed, the two base plates 12 are inserted into the coupling members 14, and the two second side plates 30 each have the two sliding plates 34 moving toward the middle plate 32. The coupling member 14 is unmovable relative to the middle plate 32 via the lugs 146 of the coupling member 14 engaging in the recesses 328 of the middle plate 32. When the indicating buttons 1275, 1295 of the first installing arm 1272 and the second installing arm 1292 are respectively received in two innermost windows 144 of the coupling member 14, the mounting holes 70 of the recess plates 121 correspond to two innermost perforations 90 of the protrusion plates 123 of the base plates 12. The fasteners 50 can be extended through the perforations 90 and are locked in the mounting holes 70. Therefore, the storage box having the minimum width is obtained.

It can be understood that the storage box can be adjusted to have other widths by moving the base plates 12 and the sliding boards 34, until the indicating buttons 1275, 1295 are received in corresponding windows 44, the fasteners 50 are engaged in the mounting holes 70 and corresponding perforations 90.

Figure 14:
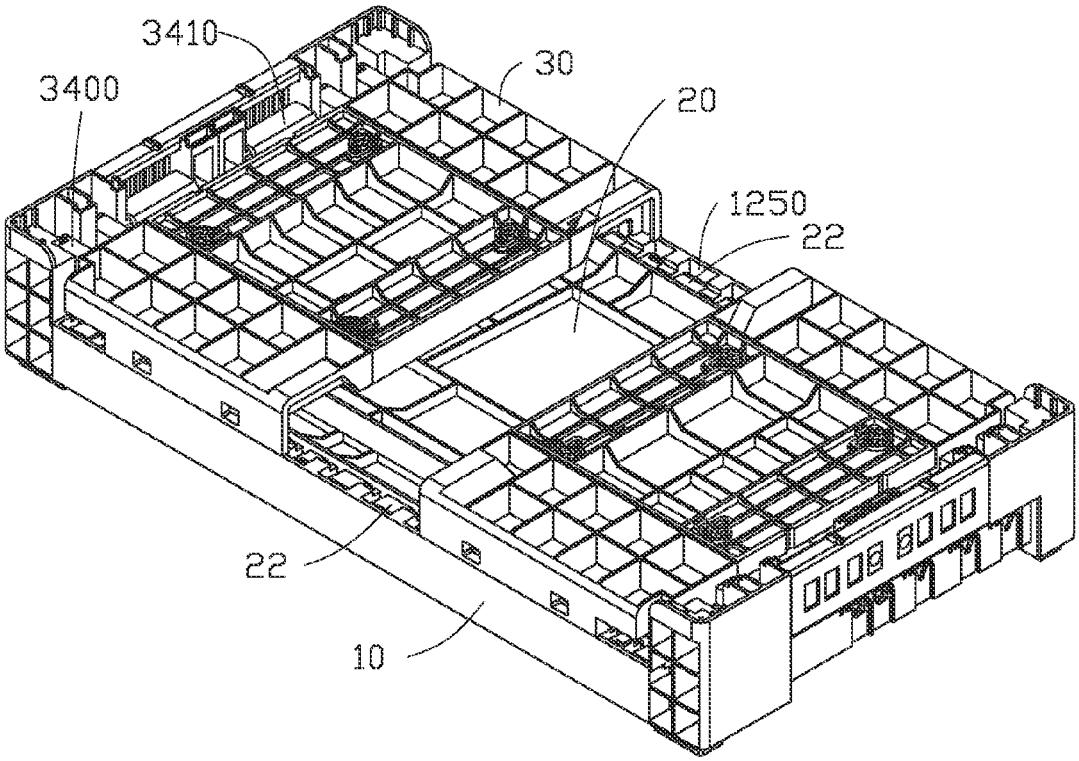
FIG. 14 is an assembled, isometric view of the storage box in FIG. 1, wherein the storage box is in a folded state.

Referring to FIG. 14, when the storage box is to be folded, the two first side plates 20 are pressed toward each other to have the buckles 24 of the first side plates 20 disengaged from the fixing holes 344 of the second side plates 30. The two first side plates 20 are arranged on the base plates 12, the two second side plates 30 are folded toward the base 10 to be located on the first side plates 20.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A storage box comprising:

a base comprising two base plates coupled to each other, each base plate comprising a fixing flange, a first sliding flange and a second sliding flange respectively extending from two opposite ends of the fixing flange;

two opposite first side plates pivotally coupled to the fixing flanges of the base plates of the base; and two opposite second side plates each comprising two sliding plates, the two sliding plates of each of the second side plates respectively and pivotally coupled to the first sliding flange of a corresponding one of the base plates and the second sliding flange of the other one of the base plates;

wherein the two base plates are configured to be movable relative to each other, the two sliding plates of each second side plate are configured to be movable relative to each other.

2. The storage box of claim 1, wherein each of the base plates can further comprises two spaced recess plates and two spaced protrusion plates staggered with the recess plates, the recess plates of each of the base plates being corresponding to the protrusion plates of the other one of the base plates.

3. The storage box of claim 2, wherein the first sliding flange of each of the two base plates is coupled with the second sliding flange of the other of two base plates via a coupling member.

4. The storage box of claim 1, wherein the first siding flange and the second sliding flange are substantially perpendicular to the fixing flange.

5. The storage box of claim 3, wherein the first sliding flange comprises a first fixing seat coupled to an end of the fixing flange and a first installing arm extending from the first fixing seat and away from the fixing flange, the second sliding flange comprising a second fixing seat coupled to an opposite end of the fixing flange and a second installing arm extending from the second fixing seat and away from the fixing flange, the first installing arm and the second installing arm facing each other and being received in a corresponding coupling member.

6. The storage box of claim 5, wherein the coupling member comprises a face plate and two fastening plates extending from two opposite sides of the face plate, the first installing arm and the second installing arm each comprising a catch defining two slots, the fastening plates being stuck in the slots.

7. The storage box of claim 6, wherein the face plate defines a plurality of spaced windows, the first installing arm and the second installing arm each further comprising an indicating button, the indicating buttons being received in corresponding windows.

8. The storage box of claim 7, wherein the indicating button is opposite to the catch on the first installing arm or the second installing arm.

9. The storage box of claim 5, wherein the first sliding flange further comprises a first sliding arm extending from the first fixing seat and away from the fixing flange, the second sliding flange comprising a second sliding arm extending from the second fixing seat and away from the fixing flange, the first sliding arm defining a plurality of spaced mounting holes, the second sliding arm defining a plurality of spaced perforations corresponding to the mounting holes, the mounting holes and the perforations being configured to receive a fastener to retain the first sliding arm with the second sliding arm.

10. The storage box of claim 9, wherein each of the base plates has the first installing arm stacked on the first sliding arm, and the second installing arm stacked on the second sliding arm.

11. The storage box of claim 1, wherein the fixing flange has an inner side thereof defining a plurality of installing grooves, at least one of the installing grooves coupled with a pivot, the first side plate forming at least a grab, the at least a grab being received in the at least one of the installing grooves and engaging with the pivot.

12. The storage box of claim 1, wherein the first sliding flange and the second flange each have an inner side thereof defining a plurality of installing grooves, the installing grooves each coupled with a pivot, the second side plate having the two sliding plates forming a plurality of grabs, the grabs of the sliding plates being received in the installing grooves of the first sliding flange and the second flange and engaging with the pivots.

13. The storage box of claim 3, wherein the second side plate further comprises a middle plate located between the two sliding plates, the two sliding plates being slidably coupled to the middle plate, the middle plate being coupled to the coupling member.

14. The storage box of claim 13, wherein the middle plate defines a recess, the coupling member extending a lug corresponding to the recess and configured to be engaged in the recess.

15. The storage box of claim 13, wherein the middle plate comprises two spaced engaging grooves and a protrusion portion located between the two engaging grooves, each of the sliding plates comprising a sliding face plate and an installing face plate extending from a side of the sliding face plate, the sliding face comprising a receiving groove receiving the protrusion portion, and two sliding portions at two opposite sides of the receiving grooves, the two sliding portions being received in the two engaging grooves, respectively.

16. The storage box of claim 15, wherein the engaging groove defines two mounting holes in two end portions thereof, the installing face plate defining a plurality of perorations corresponding to the mounting holes in the engaging groove, configured to receive fasteners to retain the sliding plates with the middle plate.

17. The storage box of claim 16, wherein the installing face plate defines a fixing hole configured to receive a buckle of the first side plate.

* * * * *